US005775213A

United States Patent [19]

Hyde

[11] Patent Number: 5,775,213

[45] Date of Patent: Jul. 7, 1998

[54] CAN CRUSHER

[76] Inventor: Carl D. Hyde, R.D. 3 Box 137 A, Palmyra, Pa. 17078

[21] Appl. No.: 883,561

[22] Filed: Jun. 26, 1997

[51] Int. Cl.[6] ..... B30B 9/32

[52] U.S. Cl. ..... 100/215; 100/291; 100/293; 100/902; D15/123

[58] Field of Search ..... 100/215, 281, 100/283, 291, 292, 293, 902; D15/123

[56] References Cited

U.S. PATENT DOCUMENTS

| | | | |
|---|---|---|---|
| 301,418 | 7/1884 | Williams | 100/292 |
| D. 341,841 | 11/1993 | Mick | D15/123 |
| 442,494 | 12/1890 | Randall | 100/291 |
| 1,402,433 | 1/1922 | Monroe | 100/902 |
| 2,373,057 | 4/1945 | Shinn | 100/902 |
| 3,009,414 | 11/1961 | Griemert | 100/902 |
| 3,659,520 | 5/1972 | Garrett et al. | 100/902 |
| 4,088,072 | 5/1978 | Wittmeier | 100/902 |
| 4,213,387 | 7/1980 | McCaney et al. | 100/902 |
| 4,291,618 | 9/1981 | Heiser et al. | 100/902 |
| 4,403,545 | 9/1983 | Toburen et al. | 100/902 |
| 4,517,892 | 5/1985 | Meisner | 100/902 |
| 5,121,685 | 6/1992 | Turner | 100/902 |
| 5,284,086 | 2/1994 | Wang et al. | 100/902 |
| 5,331,889 | 7/1994 | Bartlett et al. | 100/902 |
| 5,454,305 | 10/1995 | Becker | 100/902 |

FOREIGN PATENT DOCUMENTS

| | | | |
|---|---|---|---|
| 1016647 | 11/1952 | France | 100/292 |
| 2-92500 | 4/1990 | Japan | 100/902 |

*Primary Examiner*—Stephen F. Gerrity

[57] ABSTRACT

A can crusher for crushing aluminum cans includes a frame member for mounting to a structure. An elongate tray member for holding objects to be crushed is coupled to the frame member. An elongate handle member is pivotally coupled to the frame member. A hammer member having a can crushing portion and a slot is slidably mounted to the frame member. A roller member pivotally coupled to the handle is disposed within the slot. A stop tab extends from the frame member to position a can directly between the hammer member and the tray member. As the handle member is moved from a first position towards a second position the can crushing portion of the hammer member is moved towards the tray portion upper surface to crush an item such as a can disposed between them.

9 Claims, 3 Drawing Sheets

CAN CRUSHER

BACKGROUND OF THE INVENTION

1. Field of the Invention

The present invention relates to can crushers and more particularly pertains to a new can crusher for crushing aluminum cans.

2. Description of the Prior Art

The use of can crushers is known in the prior art. More specifically, can crushers heretofore devised and utilized are known to consist basically of familiar, expected and obvious structural configurations, notwithstanding the myriad of designs encompassed by the crowded prior art which have been developed for the fulfillment of countless objectives and requirements.

Known prior art can crushers include U.S. Pat. No. 5,293,816; U.S. Pat. No. 5,331,889; U.S. Patent No. Des. 324,390; U.S. Pat. No. 5,188,024; U.S. Pat. No. 5,287,803; and U.S. Pat. No. 5,138,941.

While these devices fulfill their respective, particular objectives and requirements, the aforementioned patents do not disclose a new can crusher. The inventive device includes a frame member for mounting to a structure. An elongate tray member for holding objects to be crushed is coupled to the frame member. An elongate handle member is pivotally coupled to the frame member. A hammer member having a can crushing portion and a slot is slidably mounted to the frame member. A roller member pivotally coupled to the handle is disposed within the slot. A stop tab extends from the frame member to position a can directly between the hammer member and the tray member. As the handle member is moved from a first position towards a second position the can crushing portion of the hammer member is moved towards the tray portion upper surface to crush an item such as a can disposed between them.

In these respects, the can crusher according to the present invention substantially departs from the conventional concepts and designs of the prior art, and in so doing provides an apparatus primarily developed for the purpose of crushing aluminum cans.

SUMMARY OF THE INVENTION

In view of the foregoing disadvantages inherent in the known types of can crushers now present in the prior art, the present invention provides a new can crusher construction wherein the same can be utilized for crushing aluminum cans.

The general purpose of the present invention, which will be described subsequently in greater detail, is to provide a new can crusher apparatus and method which has many of the advantages of the can crushers mentioned heretofore and many novel features that result in a new can crusher which is not anticipated, rendered obvious, suggested, or even implied by any of the prior art can crushers, either alone or in any combination thereof.

To attain this, the present invention generally comprises a frame member for mounting to a structure. An elongate tray member for holding objects to be crushed is coupled to the frame member. An elongate handle member is pivotally coupled to the frame member. A hammer member having a can crushing portion and a slot is slidably mounted to the frame member. A roller member pivotally coupled to the handle is disposed within the slot. A stop tab extends from the frame member to position a can directly between the hammer member and the tray member. As the handle member is moved from a first position towards a second position the can crushing portion of the hammer member is moved towards the tray portion upper surface to crush an item such as a can disposed between them.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new can crusher apparatus and method which has many of the advantages of the can crushers mentioned heretofore and many novel features that result in a new can crusher which is not anticipated, rendered obvious, suggested, or even implied by any of the prior art can crushers, either alone or in any combination thereof.

It is another object of the present invention to provide a new can crusher which may be easily and efficiently manufactured and marketed.

It is a further object of the present invention to provide a new can crusher which is of a durable and reliable construction.

An even further object of the present invention is to provide a new can crusher which is susceptible of a low cost of manufacture with regard to both materials and labor, and which accordingly is then susceptible of low prices of sale to the consuming public, thereby making such can crusher economically available to the buying public.

Still yet another object of the present invention is to provide a new can crusher which provides in the apparatuses and methods of the prior art some of the advantages thereof, while simultaneously overcoming some of the disadvantages normally associated therewith.

Still another object of the present invention is to provide a new can crusher for crushing aluminum cans.

Yet another object of the present invention is to provide a new can crusher which includes, a frame member for mounting to a structure. An elongate tray member for holding objects to be crushed is coupled to the frame member. An elongate handle member is pivotally coupled to the frame member. A hammer member having a can crushing portion and a slot is slidably mounted to the frame member. A roller member pivotally coupled to the handle is disposed within the slot. A stop tab extends from the frame member to position a can directly between the hammer member and the tray member. As the handle member is moved from a first position towards a second position the can crushing portion of the hammer member is moved towards the tray portion upper surface to crush an item such as a can disposed between them.

Still yet another object of the present invention is to provide a new can crusher that is easy to use for women and children.

Even still another object of the present invention is to provide a new can crusher that allows can feeding with simultaneous ejection of a previously crushed can.

Yet another objective of the present invention is to provide a new can crusher which has fewer moving parts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
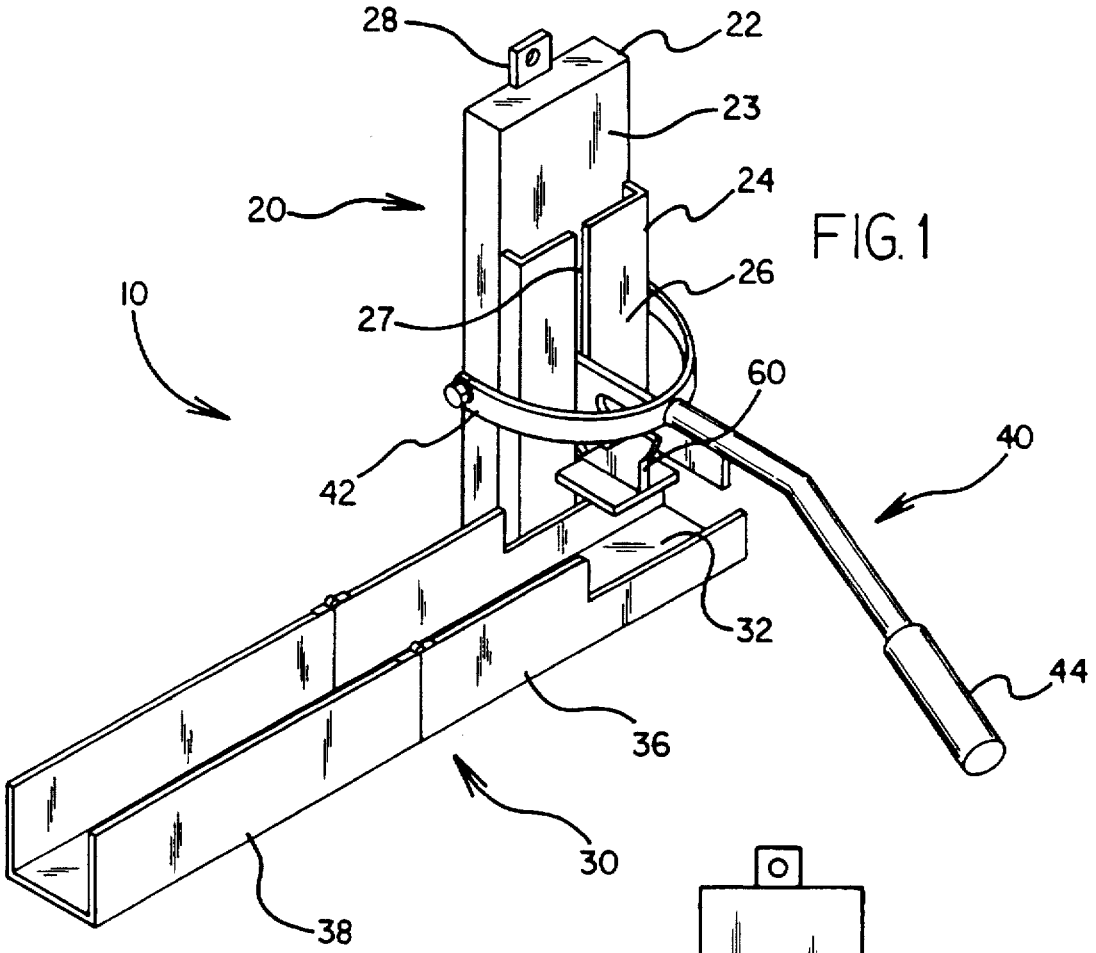
FIG. 1 is a perspective view of a new can crusher according to the present invention.

With reference now to the drawings, and in particular to FIGS. 1 through 5 thereof, a new can crusher embodying the principles and concepts of the present invention and generally designated by the reference numeral 10 will be described.

As best illustrated in FIGS. 1 through 5, the can crusher 10 comprises a frame member 20 with an elongate tray member 30 coupled to it. A hammer member 60 is slidably mounted to the frame member 20. A handle member 40 is pivotably coupled to the frame member 20 and has a roller member 50 that is disposed within a slot 67 in the hammer member 60. The handle member 40 permits positioning of the hammer member 60 between a first position 46 and a second position 48. A stop tab 70 is extended from the frame member 20 to help position an item such as a can between the hammer member 60 and the tray member 30 for crushing.

Preferably, the frame member 20 includes a base portion 22 and a bracket portion 24. The base portion 22 is designed for mounting the can crusher 10 to a structure. Ideally, a pair of tabs 28 extend from the base portion 22 to permit attachment of the base portion 22 to a structure.

Figure 4:
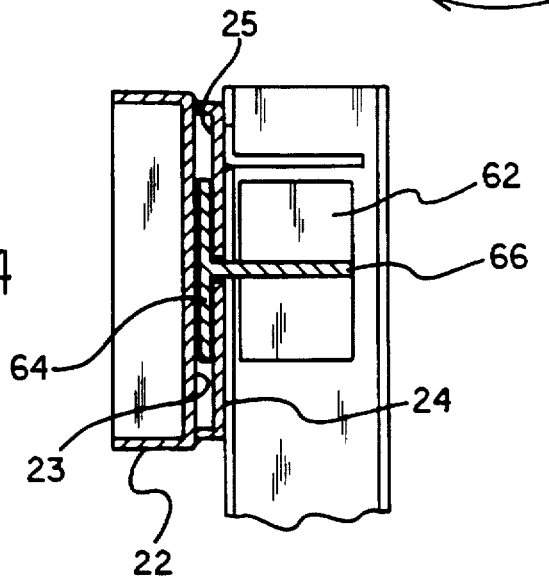
FIG. 4 is a cross sectional view with the hammer member in the first position taken from line 4—4 of FIG. 3.
Figure 5:
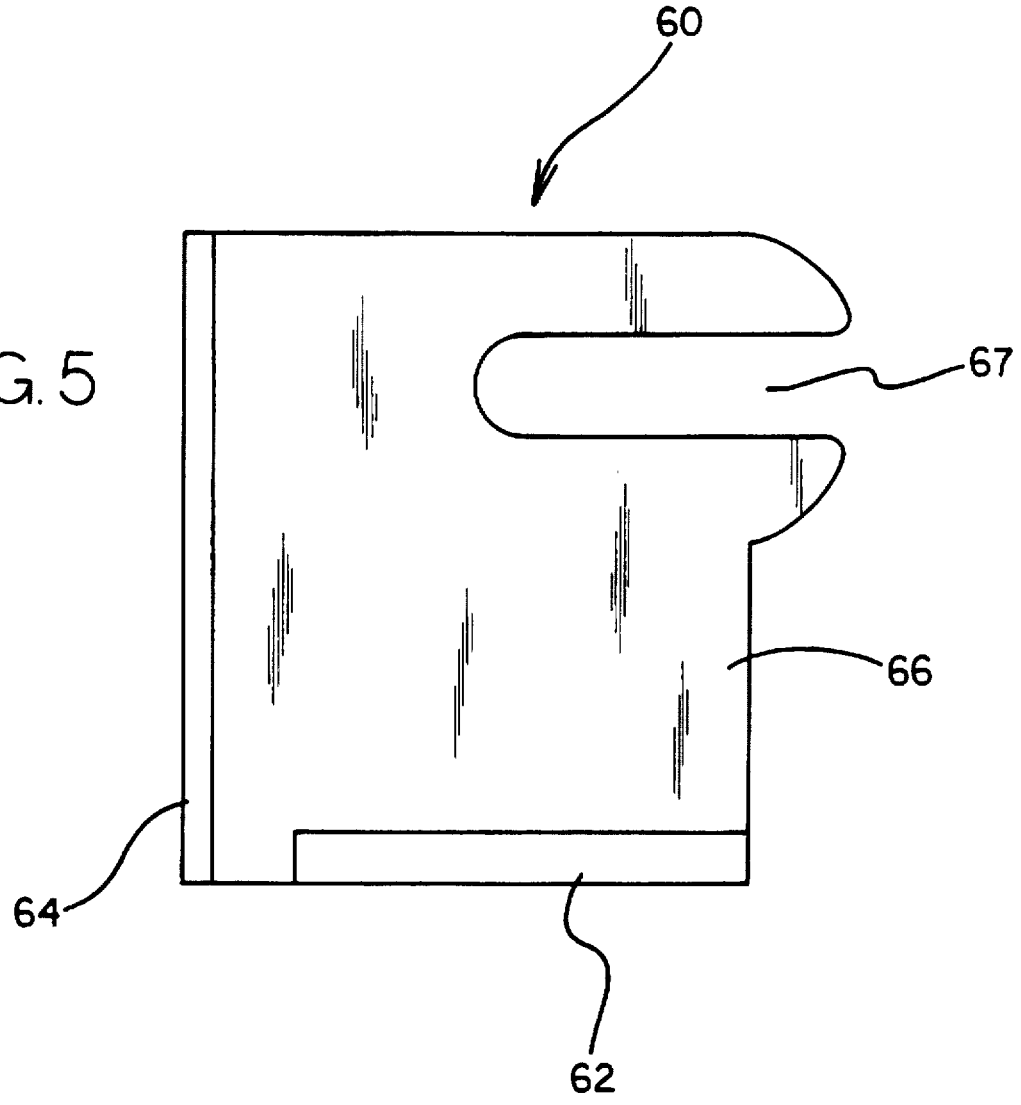
FIG. 5 is a side view of the hammer member of the present invention.

Preferably, the bracket portion 24 has an inner surface 25, an outer surface 26, and an elongate slot 27 that extends through the inner surface 25 and the outer surface 26. As illustrated in FIG. 4, the bracket portion inner surface 25 faces the front surface 23 of the base portion 22 and is spaced apart from the front surface 23 of the base portion 22.

The hammer member 60 has can crushing portion 62, a mounting portion 64, and a main portion 66. Preferably, the can crushing portion 62 faces the upper surface 32 of the tray member 30. The mounting portion 64 of the hammer member 60 is disposed between the bracket portion inner surface 25 and the base portion front surface 23. The hammer member main portion 66 is extended through the frame member slot 27 and is slidable within the slot 27.

Figure 3:
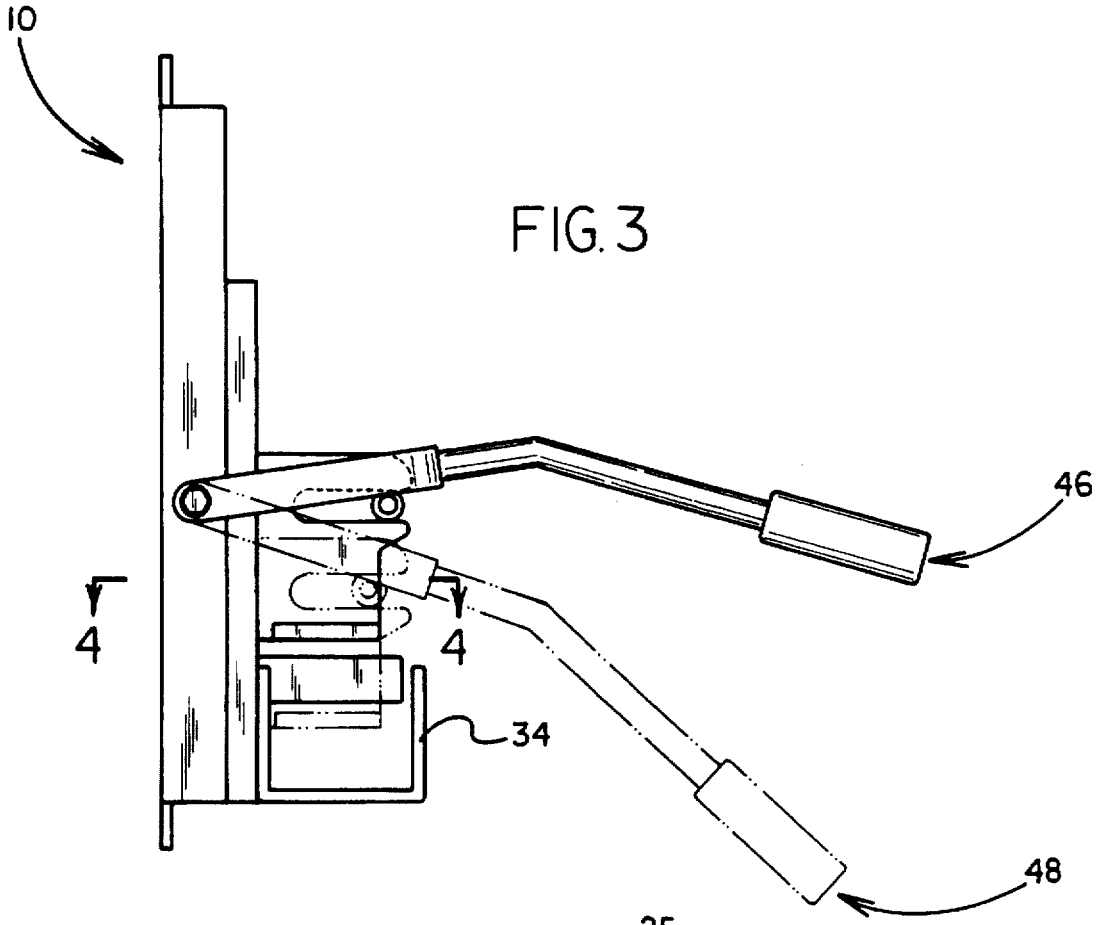
FIG. 3 is a side view taken from line 3—3 of FIG. 2.

Ideally, as shown in FIG. 3, the tray member 30 has a pair of spaced apart lateral side walls 34 that even more ideally extend from opposite sides of the upper surface 32 of the tray member 30. In use, the lateral walls 34 help align items resting on the upper surface 32 of the tray member 30 so that they can be easily positioned between the tray member upper surface 32 and the can crushing portion 62 of the hammer member 60 for more effective crushing.

Figure 2:
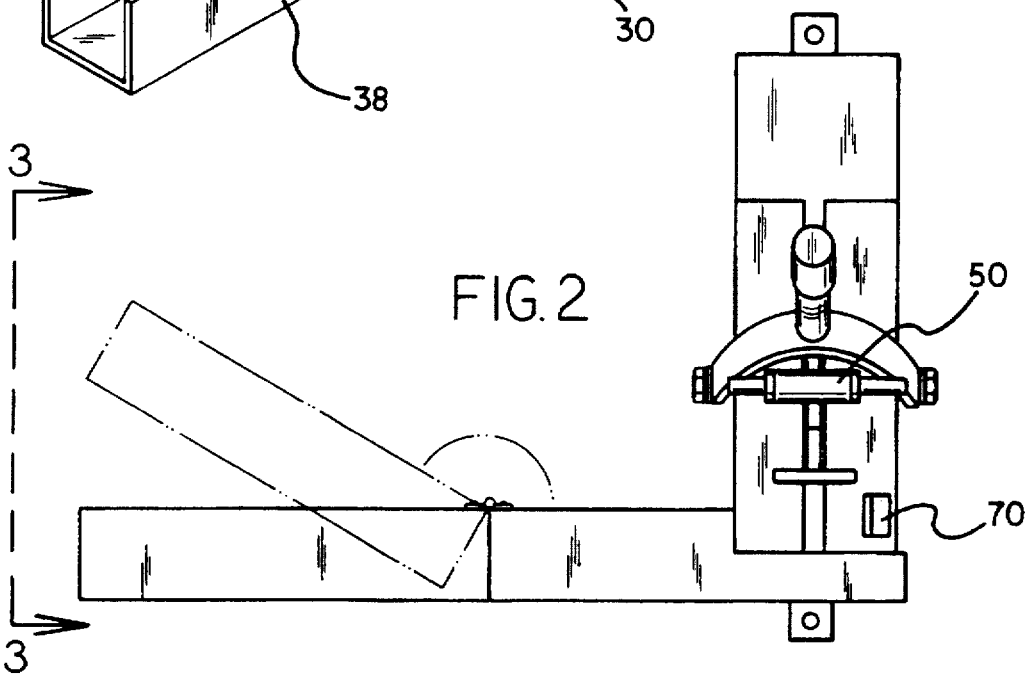
FIG. 2 is a side view of the present invention showing the pivotable tray distal portion.

Also ideally, as illustrated in FIG. 2, the tray member 30 has a proximal portion 36 and a distal portion 38. The distal portion 38 is pivotally coupled to the proximal portion 36 of the tray member 30 to allow convenient storage of the tray member 30.

The handle member 40 is pivotably coupled to the frame member 20 at the handle pivot end 42. Ideally, the handle member 40 is elongate and is bent from a straight orientation to reduce its horizontal profile while still maintaining sufficient length to provide the leverage necessary for easy crushing.

The roller member 50 is rotatably mounted on the handle member 40 and disposed in the slot 67 in the main portion 66 of the hammer member 60. Preferably, the roller member 50 is cylindrical in shape to aid movement of the roller member 50 within the hammer member main portion slot 67.

Preferably, the stop tab 70 extends from the frame member 20 to help position a can between the can crushing portion 62 of the hammer member 60 and the upper surface 32 of the tray member 30. Ideally, the stop tab 70 is spaced apart from the tray member upper surface 32 to permit a crushed can to pass between the stop tab 70 and the tray member upper surface 32.

In use, the handle member 40 is moved into the first position 46 and a can or several of them are placed on the tray member upper surface 32. The can or row of cans is then pushed towards the stop tab 70 until the can or cans are stopped. When the handle member 40 is moved towards the second position 48 the hammer member 60 moves towards the tray member upper surface 32 to crush a can positioned therebetween.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A can crusher, comprising:

a frame member for mounting to a structure;

an elongate tray member having an upper surface, said tray member being coupled to said frame member, said tray member upper surface for resting cans thereon;

an elongate handle member having a pivot end and a handle end, said pivot end being pivotally coupled to said frame member to permit pivoting of said handle member between an first position and a second position;

a roller member being rotatably mounted on said handle member;

a hammer member having a can crushing portion, a mounting portion and a main portion, said main portion having a slot, said roller member being disposed within said hammer member main portion slot, said mounting portion being slidably mounted to said frame member, said can crushing portion facing said tray member upper surface, said hammer member can crushing portion being moved towards said tray portion upper surface when said handle member is moved towards said second position, said hammer member can crushing portion being moved away from said tray portion upper surface when said handle member is moved towards said first position; and a stop tab being extended from said frame member, said stop tab being for helping position a can between said hammer member can crushing surface and said tray member upper surface.

2. The can crusher of claim 1, wherein said frame member includes a base portion for mounting to a structure having a front surface, and a bracket portion having an inner surface, an outer surface and an elongate slot being extended through said inner surface and said outer surface, said bracket portion inner surface facing said base portion front surface, said bracket portion inner surface being spaced apart from said base portion front surface.

3. The can crusher of claim 2, wherein said hammer member mounting portion is disposed between said bracket portion inner surface and said base portion outer surface, said hammer member main portion being extended through said bracket portion slot, said hammer member being slidable within said bracket member slot.

4. The can crusher of claim 1, wherein said tray member has a pair of spaced apart lateral side walls being extended from said tray member upper surface, said lateral walls being for helping align cans resting on said tray member upper surface between said tray member upper surface and said hammer member can crushing portion.

5. The can crusher of claim 1, wherein said tray member has a proximal portion and a distal portion, said tray member distal portion being pivotally coupled to said tray member proximal portion for aiding convenient storage of said tray member.

6. The can crusher of claim 1, wherein said handle member is bent from a straight orientation to reduce the horizontal profile of said handle member.

7. The can crusher of claim 1, wherein said roller member is cylindrical to aid rotation of said roller member within said hammer member main portion slot.

8. The can crusher of claim 1, wherein said stop tab is spaced apart from said tray member upper surface to permit a crushed can to pass between said stop tab and said tray member upper surface.

9. A can crusher, comprising:

a frame member including:

a base portion for mounting to a structure having a front surface;

a bracket portion having an inner surface, an outer surface, and an elongate slot being extended through said inner surface and said outer surface, said bracket portion being coupled to said base portion, said bracket portion inner surface facing said base portion front surface, said bracket portion inner surface being spaced apart from said base portion front surface;

an elongate tray member having a proximal portion, a distal portion, and an upper surface, said tray member being coupled to frame member, said tray member distal portion being pivotally coupled to said tray member proximal portion for aiding convenient storage of said tray member, said tray member upper surface for resting cans thereon;

an elongate handle member having a pivot end and a handle end, said pivot end being pivotally coupled to said frame member to permit pivoting of said handle member between an first position and a second position, said handle member being bent from a straight orientation to reduce the horizontal profile of said handle member;

a cylindrical roller member being rotatably mounted on said handle member;

a hammer member having a can crushing portion, a mounting portion and a main portion, said main portion having a slot, said roller member being disposed within said hammer member main portion slot, said mounting portion being disposed between said bracket portion inner surface and said base portion outer surface, said hammer member main portion being extended through said bracket portion slot, said hammer member being slidable within said bracket member slot, said can crushing portion facing said tray member upper surface, said hammer member can crushing portion being moved towards said tray portion upper surface when said handle member is moved towards said second position, said hammer member can crushing portion being moved away from said tray portion upper surface when said handle member is moved towards said first position; and a stop tab being extended from said frame member towards said tray member, said stop tab being for helping position a can between said hammer member can crushing surface and said tray member upper surface.

* * * * *